US005983506A

United States Patent [19]

Glesser

[11] Patent Number: 5,983,506

[45] Date of Patent: Nov. 16, 1999

[54] KNIFE GRIPPING SURFACE

[75] Inventor: Louis S. Glesser, Golden, Colo.

[73] Assignee: Spyderco, Inc., Golden, Colo.

[21] Appl. No.: 08/976,788

[22] Filed: Nov. 24, 1997

Related U.S. Application Data

[63] Continuation-in-part of application No. 08/651,666, May 21, 1996, Pat. No. 5,689,890.

[51] Int. Cl.[6] ..... B26B 1/10

[52] U.S. Cl. ..... 30/340; D8/99

[58] Field of Search ..... 30/198, 340, 526; 16/110 R; 473/300; D8/98, 99; D21/756

[56] References Cited

U.S. PATENT DOCUMENTS

D. 347,563 6/1994 Okada ..... D8/99
D. 361,253 8/1995 McCoy ..... D8/98

*Primary Examiner*—Douglas D. Watts
*Attorney, Agent, or Firm*—Sheridan Ross P.C.

[57] ABSTRACT

A device having a surface which is adapted to be gripped by a user wherein the surface reduces slippage at the user's hand. The surface geometry of the handle portion substantially reduces slippage that can occur when an instrument is in use. Preferably, the hand held instrument is a knife. The surface of the handle is covered with protuberances having angled planar surfaces which create a plurality of apexes designed to minimize hand slippage.

11 Claims, 5 Drawing Sheets

KNIFE GRIPPING SURFACE

This application is a continuation-in-part application of U.S. patent application Ser. No. 08/651,666, filed May 21, 1996, now U.S. Pat. No. 5,689,890 which is incorporated herein by reference in its entirety.

FIELD OF THE INVENTION

The present invention relates to a surface having a plurality of protuberances which are adapted to reduce slippage in multiple directions of, for example, a user's hand gripping the surface. The present invention is particularly useful for instruments such as hand-held knives or tools where slippage of a user's hand can cause injury.

BACKGROUND OF THE INVENTION

Hand-held devices, such as knives or other tools, typically include a working portion (e.g. a blade) and a handle portion that is adapted to be gripped by the hand of a user so that the working portion can be manipulated. One problem associated with such devices is that slippage of the device can occur when excessive force is applied by the user to the device or when the user's grip on the handle loosens. Such slippage can seriously injure the user or others in the vicinity of the user.

Some hand-held devices are adapted to reduce slippage in one direction or have a uniform surface pattern to reduce slippage equally in all directions without consideration of the direction of applied force. However, most designs are not well suited to adequately reduce slippage in multiple directions, e.g., both the forward and backward directions.

SUMMARY OF THE INVENTION

The present invention is directed to devices that are adapted to be gripped by a hand, including hand-held devices such as knives, wherein the devices include a surface adapted to reduce slippage of the user's hand. According to one embodiment of the present invention, a device is provided which has an outer surface adapted to be gripped by the hand of a user. The outer surface includes a plurality of first discrete protuberances having at least one apex and at least one planar surface that is angled in a first planar direction relative to the outer surface. The planar surface form an apex associated with the protuberance. The outer surface further includes a plurality of second discrete protuberances having a planar surface angled in a second planar direction relative to the outer surface. The planar surface forms an apex associated with each protuberance wherein the second planar direction is different than the first planar direction to advantageously provide slip resistance in at least two directions.

According to one preferred embodiment of the present invention, the height of the apexes progressively increase relative to the outer surface in a direction away from a pre-selected line or point on the outer surface. Preferably, the first and second protuberances comprise a planar surface and an apex. In one embodiment, the planar surface is substantially arrow-shaped and the planar surface is angled so as to form an apex. In anther embodiment, the planar surface is substantially triangular in shape. The surface can be fabricated from a variety of materials including plastics, rubbers, or other wear resistant materials.

According to another embodiment of the present invention, a knife having a handle is provided. The knife includes a blade and a handle connected to the blade and adapted to be gripped by the hand of the user. The handle has an outer surface which includes a plurality of first discrete protuberances and second discrete protuberances each having planar surfaces. The planar surfaces are preferably angled in two different directions to minimize slippage of the knife in the hand of the user.

According to another embodiment of the invention, a folding knife is provided. The folding knife includes a handle having opposite elongated side portions separated by a spacer defining a cavity therebetween, wherein each of the side portions has an outer surface. The knife also includes a blade pivotally mounted on the handle and moveable between alternate positions of being stored within the cavity or being opened in an operative position. Each of the outer surfaces includes a plurality of discrete protuberances, each having a planar surface angled relative to the outer surface wherein the height of the apexes formed by the planar surface increases relative to the outer surface in a direction away from a preselected line or point on the outer surface.

DETAILED DESCRIPTION OF THE INVENTION

The present invention relates to a surface that is particularly useful for devices such as hand-held instruments or tools. The surface structure advantageously minimizes slippage in multiple directions, for example, as the device is used by gripping the surface (e.g., on a handle) in the hand of a user manipulating the device. Such devices can include, but are not limited to, hand held tools such as a hammer, saw, drill, axe, sander, glue gun, high-pressure nozzle and the like, and other devices such as fishing poles, broom handles, cookware, glassware, pens and pencils, door knobs, checkbooks or steering wheels. The present invention is particularly applicable to the handle of a knife, such as a folding knife.

According to the present invention, the outer surface includes a plurality of protuberances having a shape which is adapted to minimize slippage. Preferably, the outer surface includes protuberances which are oriented in at least two different directions to reduce slippage in those corresponding two different directions. The protuberances include angled surfaces that are angled relative to the outer surface to form at least one apex which advantageously reduces slippage. In one embodiment, the angled surface of the protuberances is angled in at least two different directions as to provide at least one apex to reduce slippage in multiple directions. In a preferred embodiment, the height of the apexes of the protuberances increases toward the outer portions of the outer surface of the device. As used in this invention, an "apex" is defined as the highest point on a given plane, as opposed to an edge, which may be the highest given point of a non-pointed plane, such as a rectangular-shaped planar surface. In another embodiment, the protuberances can be a smooth rounded point rather than a sharp point to reduce the possibility of discomfort to a user's hand.

As discussed above, the present invention is useful for a number of devices and is particularly useful for the handle of a knife, such as a folding knife. For purposes of clarity of the present invention, such a knife is illustrated in FIG. 1.

Figure 1:
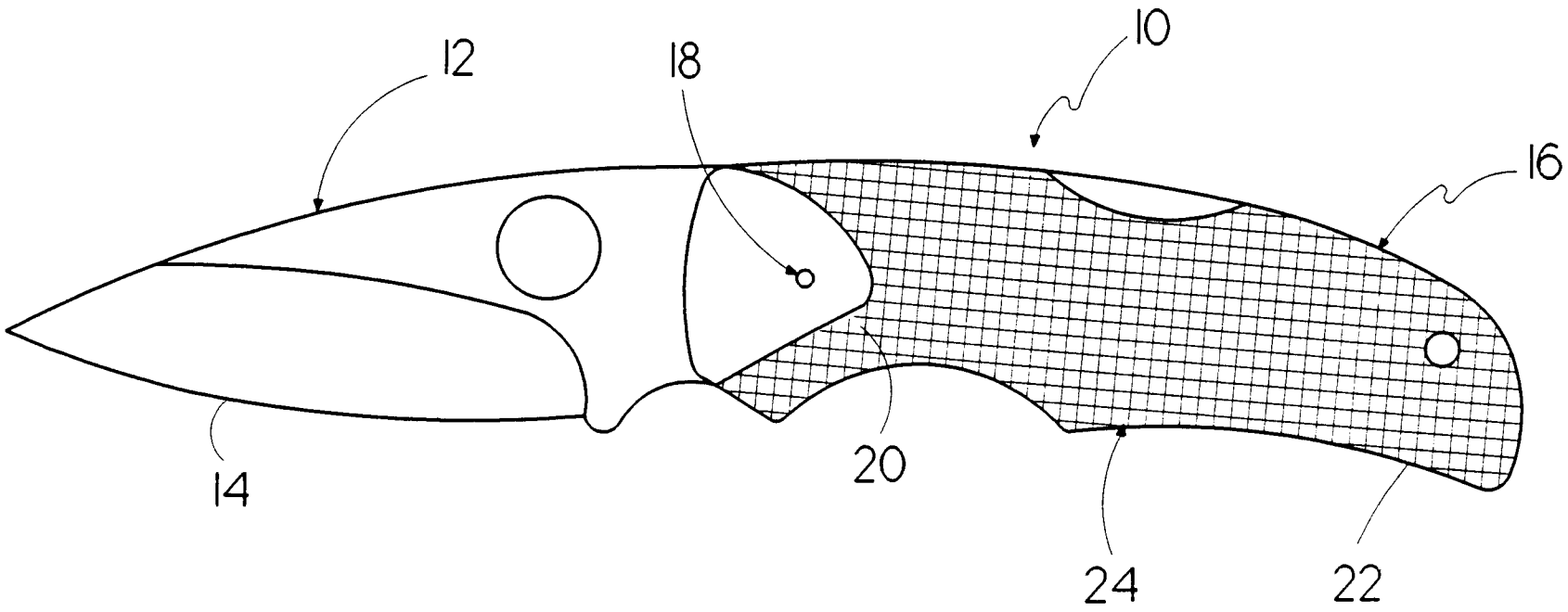
FIG. 1 illustrates a folding knife according to one embodiment of the present invention.

Referring to FIG. 1, the knife 10 includes a blade portion 12 having a sharpened edge 14 adapted for cutting. The knife 10 also includes a handle portion 16 adapted to be gripped by the hand of a user.

The knife 10 is a folding knife and therefore the blade portion 12 is connected to the handle portion 16 and pivots about a point 18 so that the blade portion 12 can be folded into the handle portion 16 for storage. According to the present invention, the outer surface of the handle portion 16 includes a plurality of protuberances, such as those labeled at 20 and 22, to reduce slippage of the knife 10 in the hand of the user.

Figure 2:
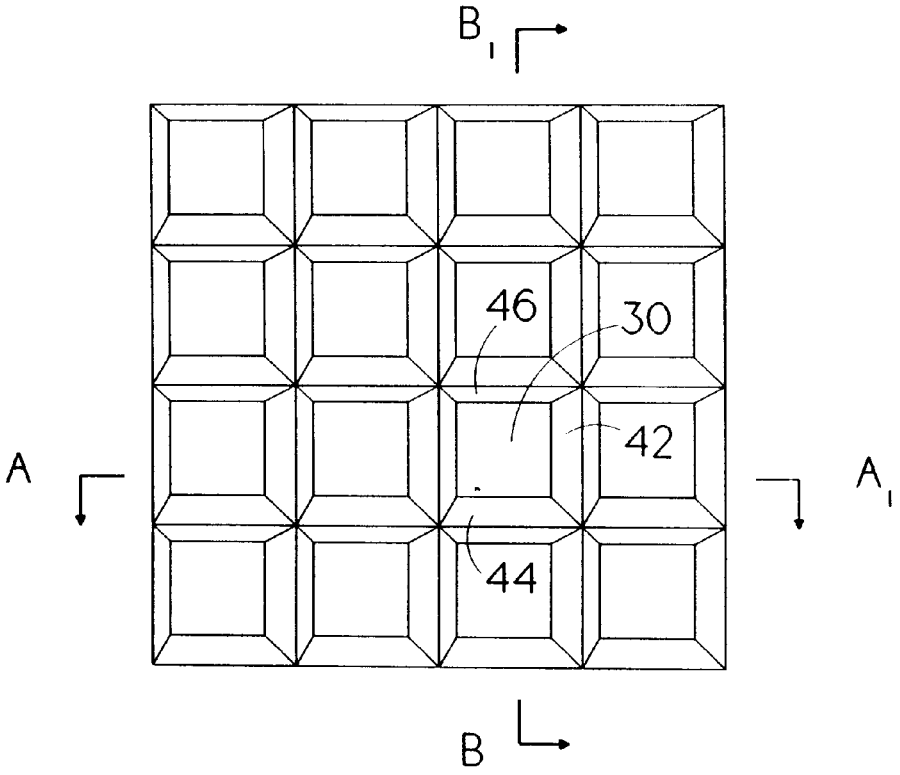
FIG. 2 illustrates the detail of the surface of according to one embodiment of the present invention.
Figure 3:
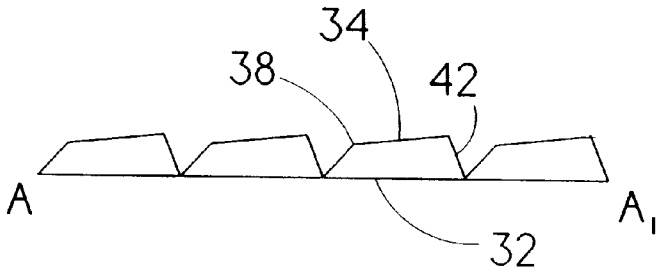
FIG. 3 illustrates a cross-section taken along line A—$A_1$ of FIG. 2.
Figure 4:
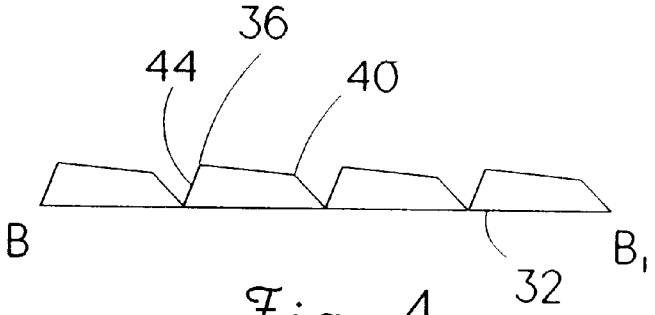
FIG. 4 illustrates a cross-section taken along line B—$B_1$ of FIG. 2.

Referring to FIGS. 2–4, a closeup view of surface protuberances according to one embodiment of the present invention is illustrated. The protuberances on the outer surface 32 include a planar surface 30 which is angled relative to the outer surface 32 of the handle. The term angled means that the planar surface 30 forms an acute angle with the outer surface 32 that is greater than 0° but less than about 90°. Preferably, the acute angle is from about 20° to about 60°. The angled planar surface 30 forms an apex 34. It will be appreciated that the planar surface may terminate above the outer surface 32 such that there is a lower side portion or a lower edge.

In the embodiment illustrated in FIGS. 2–4, the planar surface 30 is angled relative to the outer surface 32 in such a direction as to form one apex. This is illustrated in FIGS. 3 & 4 which are cross-sections taken at lines A—$A_1$ and B—$B_1$ respectively. Thus, the hand of a user is less likely to slip when slid in between apexes.

Figure 5:
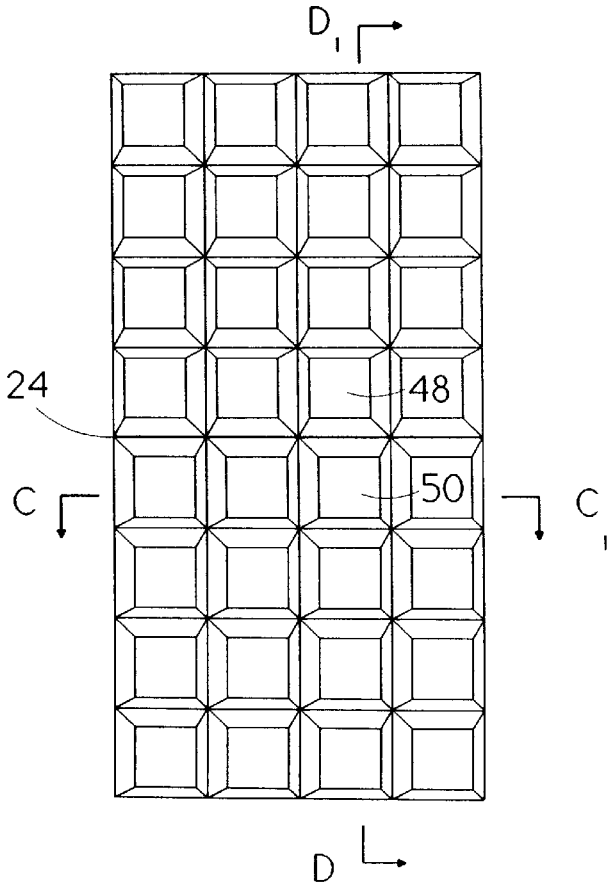
FIG. 5 illustrates the detail of the surface of according to one embodiment of the present invention.
Figure 6:
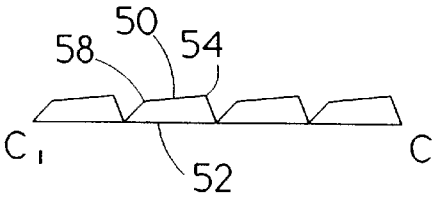
FIG. 6 illustrates a cross-section taken along line C—$C_1$ of FIG. 5.
Figure 7:
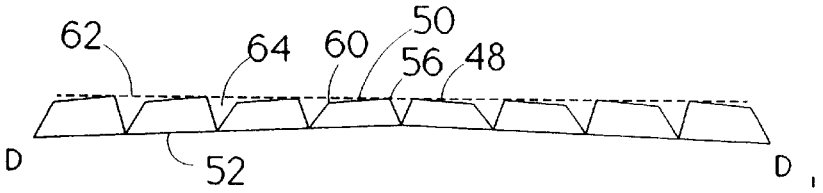
FIG. 7 illustrates a cross-section taken along line D—$D_1$ of FIG. 5.

A preferred embodiment of the invention is illustrated in FIGS. 5–7. FIG. 5 is similar to FIG. 2 and illustrates a detailed view of the surface protuberances. However, the orientation of the protuberances is reversed along an area or line, such as at 24 (also see FIG. 1). For example, this line can be preferably located at approximately the center of the device handle. Thus, the planar surfaces 48 and 50 are angled in different directions to provide slippage resistance in at least two different directions and likely, all four possible directions.

FIG. 5 illustrates a view of the surface protuberances taken from above the handle. The protuberances include a planar surface 50 that is angled relative to the outer surface 52. The planar surfaces form an apex 34.

As is illustrated in FIG. 6, the height of the protuberances from the top to bottom (along line C—$C_1$) of the handle surface can remain substantially unchanged. However, as is illustrated in FIG. 7, the height of the protuberances relative to the outer surface 52 preferably increases moving from the line 24, for example, to the front or to the rear of the handle. However, the total height relative to an outer planar surface 62 preferably remains substantially unchanged.

Thus, according to this embodiment, the user of the instrument, due to a large number of protuberances on the surface, perceives a substantially flat grip surface 62. However, the height of apexes 34 between adjacent protuberances increases toward the front and rear of the handle. This progressively increases resistance to and advantageously assists in minimizing slippage of the instrument in both the forward and rearward working directions.

Figure 9:
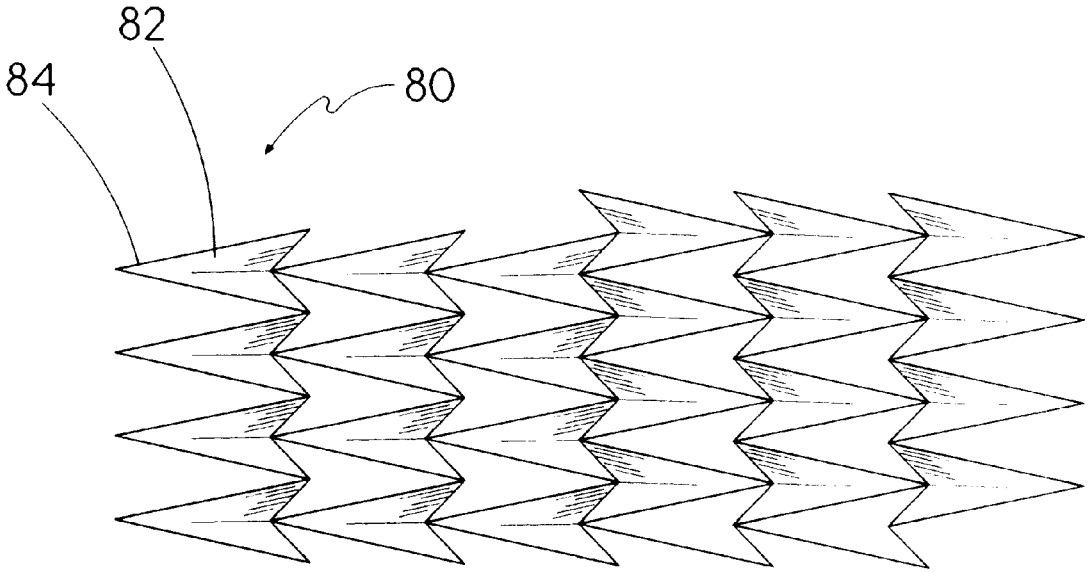
FIG. 9 illustrates the detail of the surface according to one embodiment of the present invention.

Although illustrated in FIGS. 1–7 as being substantially pyramidal, it will be appreciated that the surface protuberances according to the present invention can take a variety of shapes. For example, FIG. 9 illustrates an embodiment of the present invention wherein the protuberances are in the form of an arrowhead design. For example, the protuberance 80 is substantially in the shape of an arrowhead. The protuberance 80 includes a planar surface 82 and an apex 84. The apex of the protuberances is adapted to reduce slippage of the device when held in the hand of a user. The protuberances can be oriented in different directions to reduce slippage in a plurality of different directions.

Figure 8:
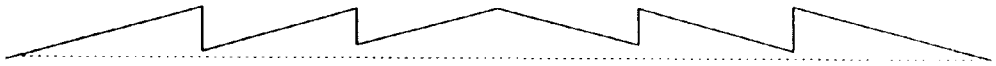
FIG. 8 illustrates a front elevational view of a plurality of protuberances according to one embodiment of the present invention.

FIG. 8 illustrates an embodiment of the invention wherein the protuberances are also substantially in the shape of an arrowhead. However, in this embodiment, the planar surface does not extend into the outer surface.

Figure 10:
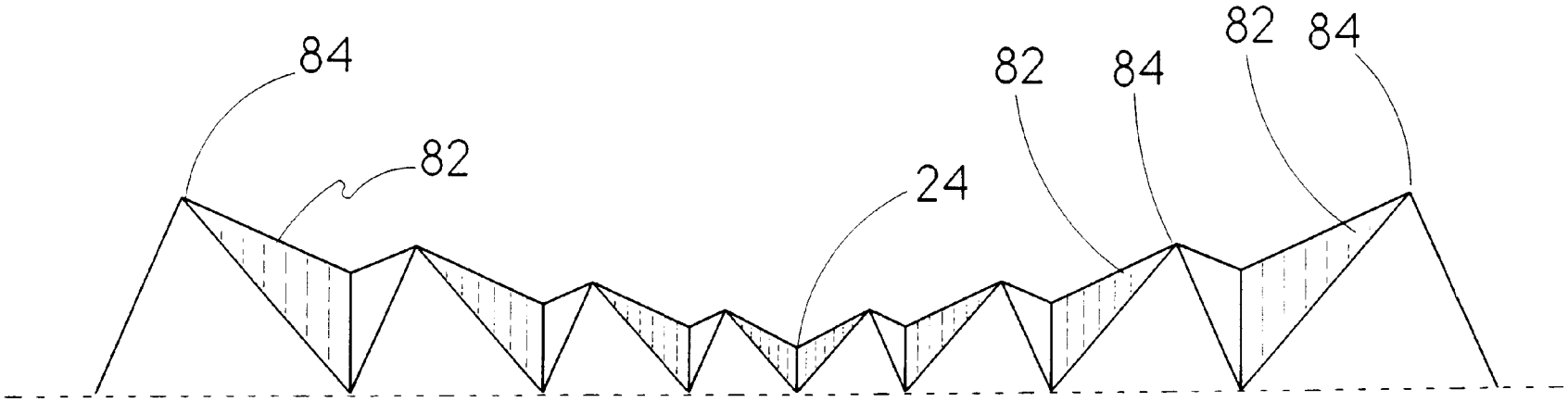
FIG. 10 is a perspective view of the surface of one row of protuberances where the height of each protuberance progressively increases in height from a preselected point or line according to one embodiment of the present invention.

FIG. 10 is an illustration of one embodiment where the protuberances are in the shape of a tetrahedron and the height of each successive apex increases progressively from the outer surface from a preselected point. In this configuration as the user of the knife handle moves a thumb or other finger away from the preselected line 24, there is additional frictional resistance as the height of the apex 84 for each succeeding protuberance increases.

In addition, it is possible to provide the surface with protuberances in a multitude of orientations on the surface. For example, FIG. 11 illustrates one embodiment of the present invention wherein the protuberances radiate from a preselected line 24 or point on the surface. In this embodiment the Apex 84 of the protuberances increases progressively in two different directions. This configuration can advantageously reduce slippage of the instrument in multiple directions.

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. A knife comprising an outer surface adapted to be gripped by the hand of a user, wherein said outer surface comprises:

(a) a plurality of first discrete protuberances, said first protuberances comprising at least one planar surface portion that is angled in a first planar direction relative to said outer surface, said planar surface having at least one apex associated with each of said first protuberances, said apexes of said first discrete protuberances progressively increasing in height relative to said outer surface as the distance from a preselected line or point on said outer surface increases; and (b) a plurality of second discrete protuberances, said second protuberances comprising said planar surface portion that is angled in a second planar direction relative to said outer surface, said planar surface having at least one apex associated with each of said second protuberances, said apexes, of said second discrete protuberances progressively increasing in height relative to said outer surface as the distance from a preselected line or point on said outer surface increases, wherein said second planar direction is different than said first planar direction to provide slip resistance in at least two distinct directions.

2. The knife of claim 1, wherein said knife is a folding knife.

3. The knife of claim 1, wherein said first and second protuberances comprise at least one common apex.

4. The device of claim 1, wherein said planar surface is shaped substantially like an arrowhead.

5. The device of claim 1, wherein said planar surface is substantially triangular shaped.

6. The knife of claim 1, further comprising a clip interconnected to said knife's outer surface for removably interconnecting said knife to an object.

7. The device of claim 1, wherein said outer surface material is comprised of at least one plastic or rubber material.

8. A knife comprising an outer surface adapted to be gripped by the hand of a user, said outer surface comprising:

a multiplicity of first discrete protuberances oriented in a series of rows and columns, said rows originating at a preselected line or point on said outer surface, each of said protuberances comprising:

a planar surface oriented in a non-parallel plane to said outer surface having at least one apex which is substantially shaped like an arrowhead, wherein said apex and said surface are slip resistant to a user of said knife in two distinct directions; and wherein the height of each of said apex from said outer surface progressively increases as the distance from said preselected point increases.

9. The knife of claim 8, wherein the height of said apex from said outer cover progressively increases as the distance from said preselected point increases.

10. The knife of claim 8, further comprising a multiplicity of second discrete protuberances extending in a second direction from said preselected point and further oriented in a series of rows and columns.

11. The knife of claim 8, wherein said preselected point is substantially centered on said outer surface.

* * * * *